United States Patent [19]

Abe et al.

[11] 4,275,688

[45] Jun. 30, 1981

[54] COOLING SYSTEM FOR INTERNAL COMBUSTION ENGINE

[75] Inventors: Fumiyuki Abe; Yoshimasa Hayashi, both of Yokohama, Japan

[73] Assignee: Nissan Motor Company, Limited, Yokohama, Japan

[21] Appl. No.: 81,317

[22] Filed: Oct. 3, 1979

Related U.S. Application Data

[62] Division of Ser. No. 882,642, Mar. 2, 1978, Pat. No. 4,222,353.

[30] Foreign Application Priority Data

May 6, 1977 [JP] Japan ..... 52-1265
Aug. 24, 1977 [JP] Japan ..... 52-100576

[51] Int. Cl.[3] ..... F25B 27/00; B60H 3/04

[52] U.S. Cl. ..... 123/41.12; 123/41.46; 62/133; 62/243; 62/323.4

[58] Field of Search ..... 123/41.02, 41.12, 41.46, 123/41.49, 568; 62/133, 243, 323

[56] References Cited

U.S. PATENT DOCUMENTS

| | | | |
|---|---|---|---|
| 2,530,180 | 11/1950 | Russell | 123/41.46 |
| 3,692,007 | 9/1972 | Nilssen | 62/243 |
| 3,813,894 | 6/1974 | Bonnaud | 62/181 |
| 3,853,098 | 12/1974 | Ishikaw et al. | 123/41.12 |

*Primary Examiner*—Ronald H. Lazarus
*Attorney, Agent, or Firm*—Schwartz, Jeffery, Schwaab, Mack, Blumenthal & Koch

[57] ABSTRACT

The cooling system of an engine consists of a cooling fan for cooling an engine coolant and a drive pulley which is, in turn, drivably rotated by the crank shaft of the engine. The mechanical connection between the drive pulley and the cooling fan is released during engine acceleration under urban area cruising conditions, in order to stop or slow down the rotational speed of the cooling fan.

20 Claims, 8 Drawing Figures

COOLING SYSTEM FOR INTERNAL COMBUSTION ENGINE

This is a division of application Ser. No. 882,642, filed Mar. 2, 1978, now U.S. Pat. No. 4,222,353.

BACKGROUND OF THE INVENTION

This invention relates to a cooling system for internal combustion engines, and more particularly to an improvement in the cooling device for an engine coolant flowing through the engine.

In connection with engine cooling systems of motor vehicle engines wherein an engine coolant is cooled by a radiator, it is well known that a cooling fan for the engine coolant is directly connected to a rotatable spindle of a water pump which is driven by an engine crank shaft. This type of the cooling system has encountered the following problems: since engine output power consumed for driving the cooling fan increases approximately proportionally to the cube of the rotational speed of the cooling fan, a considerably large amount of the engine output power is consumed during engine acceleration under high engine speed operation and accordingly acceleration performance of the engine in such an acceleration is deteriorated with degraded engine output power and degraded fuel consumption. Furthermore, noise generated by the rotating cooling fan abruptly increases during the high speed operation in addition to increased engine noise.

In this connection, it is experienced that the consumed engine output power and the noises from the cooling fan considerably increase during engine acceleration under urban area cruising in which a throttle valve is fully opened, for example, under an operating condition where engine speed is higher than 4000 rpm, the gear in a gear box is in first or second gear position, and vehicle speed is about 50 km/h. It will be understood that such an operating condition does not continue for a long period of time and perhaps continues for 60 seconds at the most. Therefore, stopping the driven rotation of the cooling fan does not invite any trouble under such an operating condition. Conversely, such an engine operating condition continues for a long period of time during long uphill cruising in a mountainous area or in a suburban area, and accordingly engine overheating is liable to occur. Therefore, high speed driven rotation of the cooling fan must be maintained in this long uphill cruising of the vehicle.

SUMMARY OF THE INVENTION

It is the prime object of the present invention to provide an improved cooling system for an internal combustion engine by means of which the engine can be effectively cooled without generation of a high level of cooling fan noise and deterioration of engine acceleration performance during engine acceleration under urban area cruising conditions of a motor vehicle.

Another object of the present invention is to provide an improved cooling system for an internal combustion engine of the type wherein an engine coolant is used to cool the engine, by means of which the driven rotation of a cooling fan is stopped so as to prevent generation of a high level of noise of the cooling fan and degradation of engine acceleration performance during engine acceleration, under urban area cruising conditions.

A further object of the present invention is to provide an improved cooling system for an internal combustion engine of the type wherein an engine coolant is used to cool the engine, by means of which the driven rotation of the cooling fan is stopped during acceleration under urban area cruising conditions, or during a predetermined time duration after beginning of an engine operation condition under which the engine acceleration is carried out, thereby preventing generation of a high level of cooling fan noise and decreasing engine output power consumed for driven rotation of the cooling fan.

A still further object of the present invention is to provide an improved cooling system for an internal combustion engine of the type wherein an engine coolant is used to cool the engine, by means of which the driven rotation of a cooling fan is securely maintained during long uphill cruising of a vehicle, thereby preventing the engine from overheating during the long uphill cruising in a mountainous area and in a suburban area.

Other objects, features and advantages of the cooling system according to the present invention will be apparent from the following description taken in conjunction with the accompanying drawings.

DESCRIPTION OF THE PREFERRED EMBODIMENTS

Figure 1:
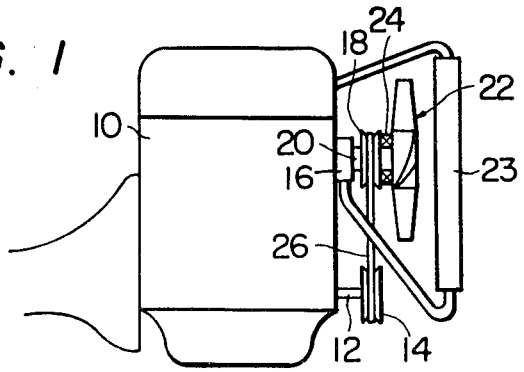
FIG. 1 is a schematic illustration of an internal combustion engine equipped with a cooling system in accordance with the present invention.

Referring now to FIG. 1 of the drawing, a preferred embodiment of an engine cooling system (no numeral) according to the present invention is shown in combination with an automotive internal combustion engine which is mounted on a motor vehicle (not shown). The engine consists of an engine proper 10 having a crank shaft whose one end 12 is shown. A crank pulley 14 is securely mounted on the one crank shaft end 12 so as to rotate with the crank shaft.

A water pump 16, forming part of the engine cooling system, is mounted on the engine proper 10 to circulate an engine coolant through a coolant passage (not shown) formed in the engine proper 10. The water pump 16 is driven by a drive pulley 18 through a rotatable shaft 20. The drive pulley 18 also serves to rotate through a clutch means 24 a cooling fan 22 forming part of an engine cooling system. The cooling fan 22 serves to cool hot engine coolant flowing through a radiator 23. As seen, the drive pulley 18 is driven by the crank pulley 14 through a V-belt 26.

Figure 2:
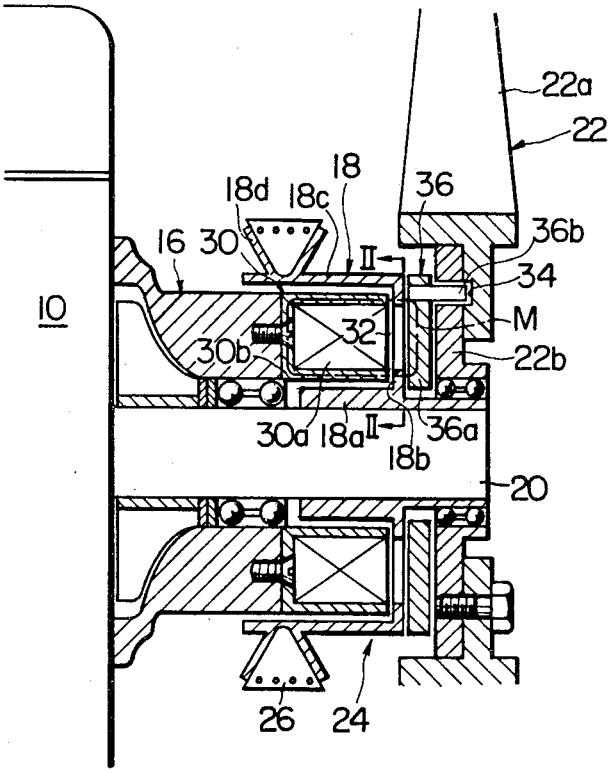
FIG. 2 is a cross-sectional view showing an example of a clutch means used in the cooling system of FIG. 1.
Figure 3:
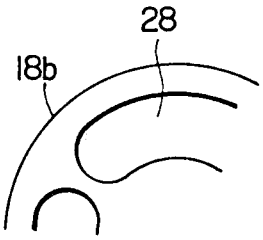
FIG. 3 is a schematic view taken along the line II—II of FIG. 2.

FIG. 2 illustrates in detail the clutch means 24, in which the drive pulley 18 includes a hub portion 18*a* which is secured to the surface of the rotatable shaft 20. The hub portion 18*a* is formed integrally with an annular disc portion 18*b* which has a plurality of openings 28 which are circumferentially arranged and spaced apart from each other as clearly shown in FIG. 3. The annular disc portion 18*b* is further formed integrally with a cylindrical portion 18*c* on which a belt receiving portion 18*d* is integrally formed to securely receive the V-belt 26. At least the annular disc portion 18*b* is made of a magnetic material.

The reference numeral 30 designates an annular electromagnetic member 30 which is composed of an annular electromagnetic coil 30*a* and a coil casing 30*b* enclosing the coil 30*a*. The coil casing 30*b* is formed with an annular opening 32 which is opposed to one surface of the annular disc portion 18*b*. The coil casing 30*b* is, as shown, secured to the body of the water pump 16.

A cooling fan 22 includes a plurality of fan blades 22*a* and an annular supporting portion or member 22*b* or which the fan blades 22*a* are securely supported. The annular supporting portion 22*b* is rotatably mounted through a bearing (no numeral) on the hub portion 18*a* of the drive pulley 18. The supporting portion 22*b* is formed with a plurality of bores or holes 34 which are circumferencially arranged and spaced apart from each other.

Disposed between the supporting portion 22*b* of the cooling fan and the disc portion 18*d* of the drive pulley is a connecting member 36 which is composed of an annular disc member 36*a* which is made of a magnetic material. A plurality of pins 36*b* are inserted and secured to the disc member 36*a*. The pins 36*b* are circumferencially arranged and spaced apart from each other and each pin 36*b* is movably disposed in each bore 34 formed in the supporting portion 22*b* of the cooling fan 22.

With this arrangement, when the electromagnetic member 30 is energized to develop a magnetic field indicated as M by means of a control circuit discussed hereinafter, the magnetic disc member 36*a* is caused to urgingly contact one surface of the annular disc portion 18*b* to rotate with the drive pulley 18. As a result, the cooling fan 22 is forced to rotate with the drive pulley 18 by means of the pins 36*b* movably inserted into the bores of the supporting portion 22*b* of the cooling fan 22. One the contrary, when the electromagnetic member 30 is de-energized, the mechanical connection between the drive pulley 18 and the cooling fan 22 is released and consequently the cooling fan 22 can not be driven by the driven pulley 18.

Figure 4:
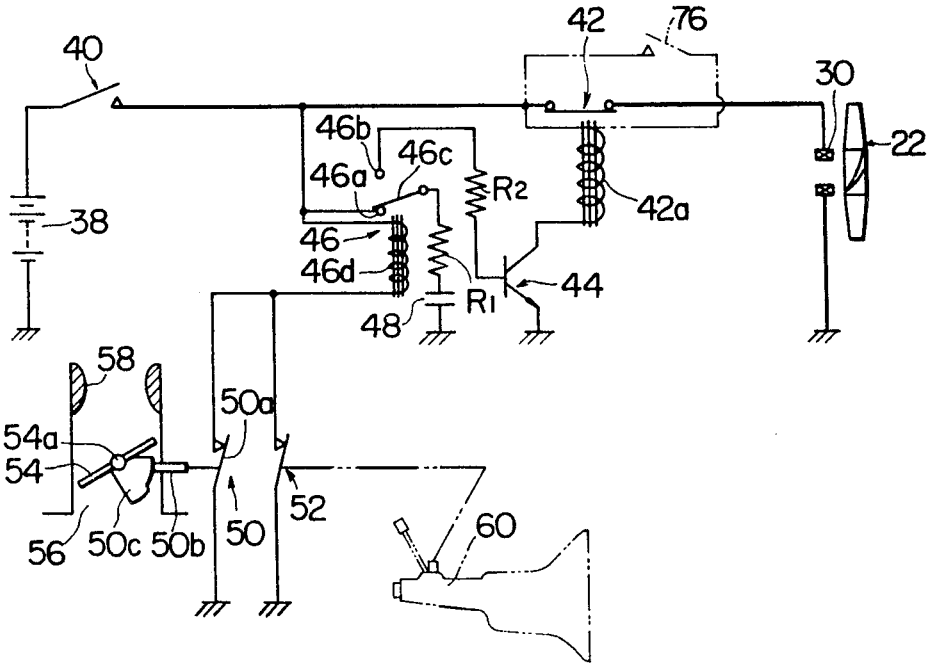
FIG. 4 is a schematic illustration of a first preferred embodiment of the cooling system according to the present invention.

FIG. 4 illustrates an example of the control circuit for the electromagnetic member 30 of the clutch means 24 shown in FIG. 2. The electromagnetic member 30 is electrically connected to an electric source such as a battery 38 through an ignition switch 40 and a clutch switch or a normally closed electromagnetic relay 42 having an electromagnetic coil 42*a*. The clutch switch 42 is, as shown, connected in series with the electromagnetic member 30 and constructed and arranged to open to block supply of electric current to the electromagnetic member 30. The electromagnetic coil 42*a* is electrically connected to the base of a power transistor 44. The base of the transistor 44 is electrically connected through a resistor $R_2$ to a stationary contact 46*b* of an electromagnetic relay 46. The relay 46 is equipped with another stationary contact 46*a* and a movable contact 46*c*. The stationary contact 46*a* is electrically connected to a line (no numeral) connecting the ignition switch 40 and the clutch switch 42. The movable contact 46*c* is electrically connected through a resistor $R_1$ to a condenser 48. The electromagnetic coil 46*d* of the relay 46 is electrically connected to a normally closed throttle position switch 50 and a normally closed gear position switch 52 which is electrically connected in parallel to the throttle position switch 50. The throttle position switch 50 has a movable contact 50*a* which is mechanically connected to a cam follower member or rod 50*b*. The cam follower member 50*b* is arranged to be urged toward and slidably move on the cam face of a cam 50*c*. The cam 50*c* is constructed and arranged to move with the movement of a throttle valve 54. In this instance, the cam 50*c* is securely mounted on a throttle valve shaft 54*a* on which the throttle valve 54 is fixedly mounted. The throttle valve 54 is, as customary, rotatably disposed in an intake passageway 56 downstream of a venturi portion 58. Through the intake passageway 56, air-fuel mixture is inducted into the combustion chambers (not shown) formed in the engine proper 10. The cam face of the cam 50*c* is designed so that when the throttle valve 54 opens over a predetermined amount, i.e., 90% of an angle defined between the fully closed and fully opened positions of the throttle valve, the cam follower member 50*b* is moved to the right in the drawing and consequently the movable contact 50*a* separates from the stationary contact (no numeral) to open the throttle position switch 50.

The gear position switch 52 is constructed and arranged to open when the gear in a gear box 60 of the engine is in a range including first (low) gear and second gear positions.

In operation of the arrangement shown in FIG. 4, when the engine begins to run by closing the ignition switch 40, the electric current flows to the electromagnetic coil 46*d* of the relay 46 as long as either one of the throttle position and gear position switches is closed. Consequently, the electromagnetic coil 46*d* is energized in maintain the movable contact 46*c* to contact to the stationary contact 46*a* and accordingly the electric current is supplied through the resistor $R_1$ to the condenser 48 to store electricity in the condenser 48. The resistor $R_1$ serves to control storing electricity in the condenser 48. Hence, the electric current is supplied through the closed clutch switch 42 to the electromagnetic member 30 of the clutch means 24 so as to energize the member 30. As a result, the secure mechanical connection between the drive pulley 18 and the cooling fan 22 is established to rotate the cooling fan 22.

When the engine is accelerated by operating the throttle valve 54 to widely open over 90% of the angle defined by its fully closed and fully opened positions, the cam 50*c* pushes the follower rod 50*b* so as to open the throttle position switch 50. Then, if the gear position of the gear box 60 is still in the first or second gear position, the gear position switch 52 opens. Such an engine operation is encountered, for example, under a vehicle cruising condition in which vehicle speed is a level lower than 60 Km/h and engine speed has reached or will immediately reach to a level higher than 4000 rpm. It will be understood that, under such a vehicle cruising condition, the engine output power consumed by rotating the cooling fan is great with a high level of fan noise, though high engine power is necessary for acceleration of the engine. Thus, the opened throttle position and gear position switches 50, 52 inform of the fact that the engine is accelerated under an urban area cruising condition, thereby de-energizing the electromagnetic coil 46d of the relay 46. The movable contact 46c is, then, moved to contact the stationary contact 46b by the bias of a spring (not shown) and consequently the voltage stored in the condenser 48 is supplied through the resistors $R_1$ and $R_2$ to the base of the transistor 44 to be grounded. The resistor $R_2$ serves to control releasing time of electricity in the condenser 48. At this time, the collector current is induced in the transistor 44 thereby energizing the electromagnetic coil 42a of the clutch switch 42. This causes the clutch switch 42 to open, by which electric current supply to the electromagnetic member 30 is stopped to de-energize the electromagnetic member 30 of the clutch means 24. As a result, the mechanical connection between the cooling fan 22 and the drive pulley 18 is released and accordingly the cooling fan is rotated only by air flow due to vehicle cruising.

Such a condition continues until the stored voltage in the condenser 44 decreases below a certain level. The time duration in which such a condition continues can be controlled with the capacitor of the condenser 48 and the resistors $R_1$, $R_2$. The time duration is preferably from several seconds to 60 seconds at the most. At the time duration in which the mechanical connection between the cooling fan 22 and the drive pulley 18 is released, the engine acceleration may already terminate in the case of urban area cruising of the vehicle. During this engine acceleration, the cooling fan 22 never consumes any engine output power thereby increasing power for engine acceleration to improve acceleration performance of the engine. Additionally, this also prevents generation of cooling fan noise due to its high speed rotation.

When the time duration passes and the stored voltage in the condenser decreases below the predetermined level, the base current in the transistor 44 is decreased to a level which can not energize the electromagnetic coil 42a. Then, the clutch switch 42 is closed to energize the electromagnetic member 30. As a result, the mechanical connection between the cooling fan 22 and the drive pulley 18 is again established thereby to force the cooling fan 22 to rotate. At this time, it is necessary to rotate the cooling fan 22 since the engine acceleration will terminate in the case of urban area cruising of the vehicle. In case of uphill cruising of the vehicle in a mountainous area or in a suburban area, the operation of the cooling fan is also necessary to cool the engine coolant in order to prevent overheating of the engine.

Moreover, if an engine coolant temperature switch 76 is electrically connected between the ignition switch 40 and the clutch switch 42, it is possible to stop the rotation of the cooling fan 22 when the engine coolant temperature is below a predetermined level, for example 60° C., below which the engine cooling is not necessary.

While only the combination of throttle position and gear position switches 50 and 52 have been shown and described to detect the high engine load and low vehicle speed operation condition with reference to FIG. 4, the combination of two switches 50 and 52 may be replaced with an engine speed switch for detecting engine speed higher than 4000 rpm, or with the combination of the throttle position switch, the engine speed switch, an intake vacuum switch which detects, for example, an intake vacuum between 100 mmHg and atmospheric pressure, the gear position sensor (or a line pressure detecting switch or a kickdown switch for detecting so-called kickdown which produces transmission-forced downshift in an automatic transmission) and a vehicle speed switch for detecting, for example, a vehicle speed lower than 70 km/h.

Figure 5:
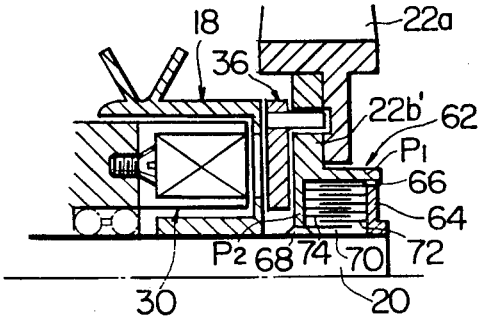
FIG. 5 is a cross-sectional view showing an improvement in a mechanism for rotating the cooling fan of the cooling system.

FIG. 5 shows an improvement in the engine cooling system, in which a fluid coupling 62 is disposed between the cooling fan 22 and the rotatable shaft 20 to transmit the rotational movement of the rotatable shaft 20 to the cooling fan 22. The fluid coupling 62 consists of a disc member 64 which is secured to the peripheral surface of the rotatable shaft 20. The disc member 64 sealingly and slidably connects through a sealing member 66 to a cylindrical portion $P_1$. An annular portion $P_2$ of the supporting member 22b' is sealingly and slidably connected through a sealing member 68 to the peripheral surface of the rotatable shaft 20. As seen, a chamber 70 is defined by the cylindrical and annular portions $P_1$ and $P_2$, the disc member 64 and the peripheral surface of the rotatable shaft 20. This chamber 70 is filled with silicon oil (not identified). The disc member 64 is formed with a plurality of fins 72 which are arranged alternately with a plurality of fins 74. The fins 74 are secured to the annular portion $P_2$ of the supporting member 22b'.

With this arrangement, even when the mechanical connection between the drive pulley 18 and the cooling fan 22 is released, the disc member 64 rotates with the rotatable shaft 20 so as to rotate the fins 72. Accordingly, by the effect of the friction force due to the viscosity of silicon oil, the fins 74 are moved with the fins 72 so as to rotate the supporting member 22b' around the rotatable shaft 20. As a result, the cooling fan 22 is relatively slowly rotated since slip is caused between the fins 72 and 74 so that fan driving force is ineffectively transmitted from the rotatable shaft 20 to the cooling fan 22. It will be appreciated that, by the above mentioned improvement, some degree of cooling effect to the engine is accomplished even during engine acceleration under urban area cruising conditions, of course preventing the engine power output from being largely consumed and generation of a high level of fan noise.

Figure 6:
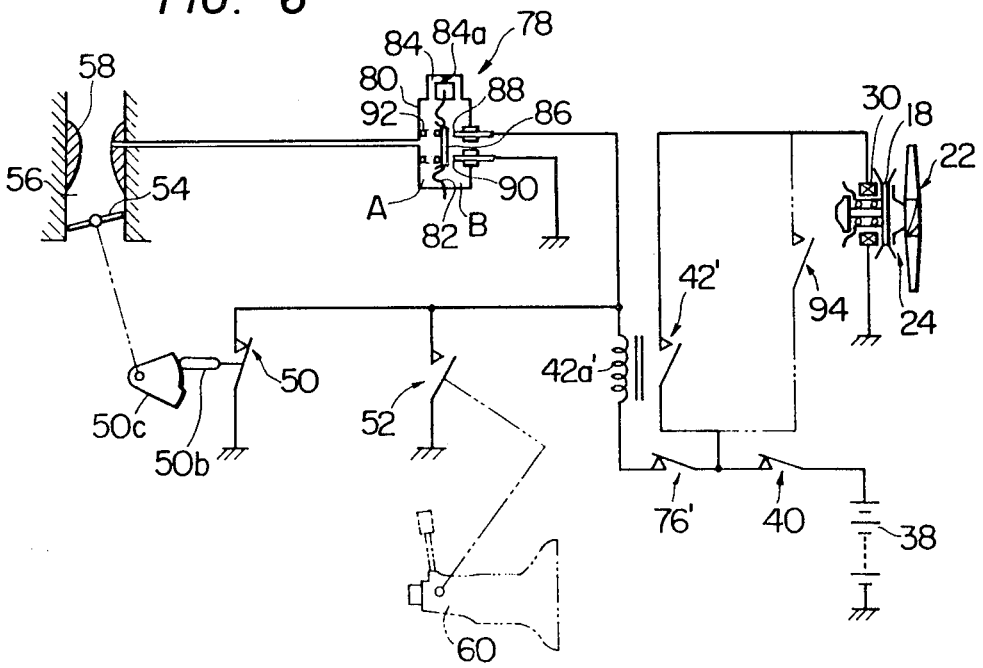
FIG. 6 is a schematic illustration of a second preferred embodiment of the cooling system according to the present invention.

FIG. 6 illustrates another preferred embodiment of the engine cooling system according to the present invention, which is similar to the embodiment shown in FIG. 4 and, as such, like reference numerals are assigned to the corresponding parts and elements. In this case, an acceleration sensitive switch 78 is electrically connected in parallel with the throttle position switch 50 and the gear position switch 52 to constitute a device (no numeral) or means for detecting the engine acceleration under urban area cruising conditions. The acceleration sensitive switch 78 consists of a casing 80 forming therein a space which is divided by a flexible diaphragm member 82 into a vacuum chamber A and an atmospheric chamber B communicating with the atmosphere. The vacuum chamber A communicates through a conduit (no numeral) with the venturi portion 58 formed in the intake passage 56. The chambers A and B communicate with each other through a passage 84 or a pipe connecting therebetween. The passage 84 is formed thereinside with an orifice 84a for restricting the air flow therebetween. A movable contact 86 is secured to the central portion of the diaphragm member 82 so as to be exposed to the atmospheric chamber B. Two stationary contacts 88 and 90 are securely supported by the casing 80 and electrically insulated from the casing 80. The two stationary contacts 88 and 90 are located to be opposite to the movable contact 86 and arranged to be contactable by the movable contact 86 when urged by the action of a compression spring 92 disposed in the vacuum chamber A. One stationary contact 88 is electrically connected to the electromagnetic coil 42*a*′ of the clutch switch 42′, whereas the other contact 90 is grounded.

With the thus arranged acceleration sensitive switch 78, when the venturi vacuum is not varied and is generally constant, the pressures in the vacuum and atmospheric chambers A and B are generally equal and consequently the movable contact 86 contacts the two stationary contacts 88 and 90 to close the acceleration sensitive switch 78. When the increasing rate of the venturi vacuum exceeds a certain level, a pressure differential is established between the vacuum chamber A and the atmospheric chamber B by the action of the orifice 84*a*. As a result, the diaphragm member 82 is moved to the left in the drawing against the bias of the spring 92, and consequently the acceleration sensitive switch 78 is opened.

As shown, the parallel circuit of the acceleration sensitive switch 78, the throttle position switch 50 and the gear position switch 52 is electrically connected in series with the electromagnetic coil 42*a*′ of the clutch switch 42′, the engine coolant temperature switch 76 and the ignition switch 40 which is electrically connected to the battery 38. The engine coolant temperature switch 76′ is arranged to open when the coolant temperature is below a predetermined level, for example 60° C.

In operation of the arrangement in FIG. 6, when the ignition switch 40 is closed to run the engine in case where the engine coolant temperature is above the predetermined level of 60° C. and consequently the engine coolant temperature switch is closed, electric current flows from the battery 38 through the ignition switch 40 and the engine coolant temperature switch 76′ to the electromagnetic coil 42*a*′ of the clutch switch 42′ as long as one of the switches 50, 52 and 78 is closed. Accordingly, the clutch switch 42′ is closed to energize the electromagnetic member 30 of the clutch means 24.

When the throttle valve 54 is widely opened over 90% of the angle defined between its fully closed and fully opened positions in order to accelerate the engine, the throttle position switch 50 is opened. Additionally, if the gear in the bear box 60 is then in the first or second gear position, the gear position switch 52 is also opened.

Figure 7:
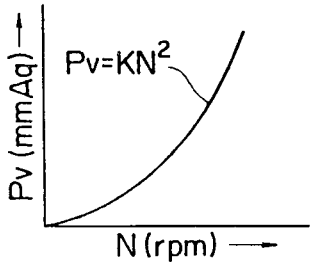
FIG. 7 is a graph showing the relationship between venturi vacuum and engine speed.

In such a condition, the venturi vacuum $P_V$ increases approximately proportionally to the square of engine speed N as seen from FIG. 7.

That is to say, $$P_V = KN^2 \quad (1)$$

Accordingly, $$\frac{dp_v}{dN} = \frac{dp_v}{dt} / \frac{dN}{dt} = 2KN \quad (2)$$

In view of the above, acceleration of the engine speed dN/dt is assumed generally constant, the increasing rate $dp_v/dt$ of the venturi vacuum increases proportionally to the engine speed N. This value $dp_v/dt$ is proportional to the pressure differential between the vacuum chamber A and the atmospheric chamber B of the acceleration sensitive switch 78.

Hence, by setting the biasing force of the spring 92 of the acceleration sensitive switch 78 at a suitable value, the switch 78 is opened by movement of the diaphragm member 82 against the biasing force of the spring 92 when the engine speed N exceeds a predetermined level during engine acceleration.

Thus, during engine acceleration under urban area cruising conditions, the three switches 50, 52 and 78 are all open to de-energize the electromagnetic coil 42*a*′ of the clutch switch 42′. As a result, flow of the electric current to the electromagnetic member 30 is interrupted so that the electromagnetic member 30 is de-energized so as to release the mechanical connection between the drive pulley 18 and the cooling fan 22. The cooling fan 22 is, then, rotated only by air flow due to vehicle cruising.

Furthermore, even in the case where the engine speed reaches to the high predetermined level, when the engine speed is maintained generally constant such as during uphill cruising of the vehicle, the pressure differential between the chambers A and B of the acceleration sensitive switch 78 is relatively small and consequently the diaphragm 82 is not moved so that the switch 78 remains closed. As a result, the cooling fan 22 is driven to rotate so as to prevent the overheating of the engine.

If the engine coolant temperature is below the predetermined level, for example 60° C., below which warming-up of the engine is necessary, the engine coolant temperature switch 76′ is opened regardless of the above-mentioned operating conditions. As a result, the mechanical connection between the drive pulley 18 and the cooling fan 22 is released to stop the driven rotation of the cooling fan 22. Hence, the warming-up of cold engine can be effectively achieved.

It will be appreciated from the foregoing, that, with the above-mentioned arrangement according to the present invention, the time duration required for engine warming-up is shortened as compared with that in cases of conventional engines, thereby achieving effective cleaning of the exhaust gases of the engine. Moreover, the above-mentioned various switches for detecting the engine operating conditions may be used also as those for an exhaust gas purifying system (not shown) and therefore the motor vehicle equipped with such an exhaust gas purifying can be produced at a low production cost.

In addition to the above-mentioned arrangement, another engine coolant temperature switch 94 is electrically connected in parallel with the clutch switch 42′ as indicated in phantom in FIG. 6. The switch 94 is arranged to close when the engine coolant temperature is above a predetermined level, for example 95° C., above which engine overheating may occur. By virtue of this engine coolant temperature switch 94, the cooling fan 22 can be rotated by the drive pulley 18 regardless of the other engine operating conditions to effectively prevent the engine overheating when the engine coolant temperature is raised and exceeds the predetermined level.

The reason why the gear position switch 52 is connected in parallel with the throttle position switch 50 in the embodiment in FIG. 6 is as follows: it will be expected that the acceleration sensitive switch 78 and the throttle position switch 50 may be opened during engine acceleration under high vehicle speed cruising in a suburban area in which the throttle valve is fully opened and the venturi vacuum increasing rate is considerably high to a degree causing the switch 78 to open. Under such an operating condition, it is undesirable to stop the driven rotation of the cooling fan 22 because of the necessity for effective engine cooling. Therefore, the gear position switch 52 is arranged to be maintained closed so as to prevent the stop of the driven rotation of the cooling fan 22 under the above-mentioned operating condition.

Figure 8:
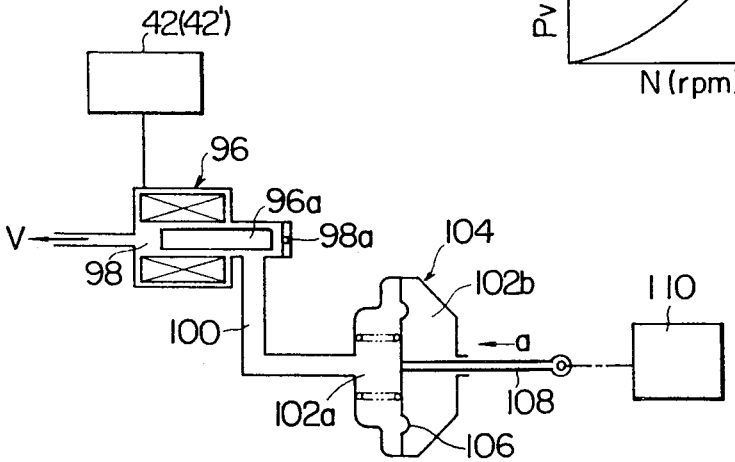
FIG. 8 is a schematic illustration showing another example of the clutch means used in the cooling system of FIG. 1.

FIG. 8 shows an example of the clutch means 24 of the type wherein a friction clutch (not shown) is used although only an electromagnet operated clutch has been shown and described with reference to FIGS. 2 to 6. The construction of the friction clutch is well known and accordingly is omitted. As clearly shown, the clutch switch 42 (42') is electrically connected to an electromagnetic valve 96 having a movable member 96*a*. The movable member 96*a* is slidably movably disposed in an elongated bore 98 which communicates at its one end with a vacuum source V such as an intake manifold (not shown) of the intake system of the engine and at the other end thereof with the atmosphere through an air induction opening 98*a*. The elongated bore 98 communicates through a conduit 100 with a vacuum operating chamber 102*a* of a diaphragm device 104. The interior of the diaphragm device 104 is divided by a flexible diaphragm member 106 into the vacuum operating chamber 102*a* and an atmospheric chamber 102*b* which communicates with the atmosphere. A rod 108 secured to the diaphragm member 106 is mechanically connected to a device 110 which is arranged to put the friction clutch into its inoperative condition so as to release the mechanical connection between the cooling fan 22 and the drive pulley 18 when the rod is moved in a direction indicated by an arrow a.

With the arrangement of FIG. 8, when the electromagnetic coil (no numeral) of the electromagnetic valve 96 is energized, the movable member 96*a* is in a position where the air induction opening 98*a* opens and accordingly the vacuum operating chamber 102*a* of the diaphragm device 104 is supplied with the atmosphere. As a result, the friction clutch is put into its operative position so as to establish the mechanical connection between the cooling fan 22 and the drive pulley 18. Conversely, when the electromagnetic coil of the valve 96 is de-energized, the movable member 96*a* is in a position to close the air induction opening 98*a* and consequently the vacuum operating chamber 102*a* of the diaphragm device 104 is supplied with vacuum from the vacuum source V, causing the diaphragm member 106 to move to the left in the drawing. Then, the rod 108 moves in the direction of the arrow a so as to put, by means of the device 110, the friction clutch into its inoperative position by means of which the mechanical connection between the cooling fan 22 and the drive pulley 18 is released.

As is appreciated from the foregoing discussion, with the cooling system according to the present invention, since the drive rotation of the cooling fan is stopped during engine acceleration under urban area cruising conditions of the motor vehicle, the generation of a high level of fan noise is prevented improving engine acceleration performance. Additionally, since the cooling fan is arranged to be driven to rotate under generally constant high engine speed operation, the engine can be effectively prevented from overheating under uphill cruising conditions of the motor vehicle.

What is claimed is:

1. A cooling system for an internal combustion engine having a crank shaft, an electric source and a throttle valve and adapted for propelling a vehicle having a gear box with a plurality of gear ranges, the system comprising:

a cooling fan for cooling the engine when rotatably driven;

means for selectively rotatably driving said cooling fan from the engine crank shaft, said driving means including a normally engaged and selectively disengageable clutch, and means, including a normally closed switch, for maintaining said clutch in its normally engaged condition; and means for disengaging said clutch during engine acceleration under an urban area cruising condition of the vehicle propelled by the engine, said disengaging means comprising:

means for detecting a first engine operating condition which is a high load and low vehicle speed engine operating condition, said detecting means including a throttle position switch arranged to open when the engine throttle valve opens over a predetermined amount representing the high load engine operating condition, and a gear position switch electrically connected in parallel with said throttle position switch and arranged to open when the gear range in the gear box is selected in a predetermined position representing the low vehicle speed operating condition;

means for detecting a second engine operating condition; and means for opening said normally closed switch in response to detection of both said first and said second engine operating conditions.

2. A cooling system as claimed in claim 1, wherein said clutch comprises:

a member driven from the engine crank shaft, a connecting member mounted for reciprocation between a first position for establishing mechanical connection between said driven member and said cooling fan, and a second position releasing the mechanical connection therebetween, said connecting member being made of a magnetic material, and an electromagnetic member located on the side of said driven member opposite to said connecting member, said electromagnetic member being arranged to urge said connecting member into said first position when energized via said normally closed switch and to release said connecting member for movement into said second position when de-energized.

3. A cooling system as claimed in claim 2, wherein said cooling fan is rotatably mounted on a rotatable shaft rotatably mounted on the engine.

4. A cooling system as claimed in claim 3, wherein said driven member comprises a drive pulley securely mounted on said rotatable shaft and means for rotatably driving said drive pulley from the engine crank shaft.

5. A cooling system as claimed in claim 4, wherein said cooling fan includes a plurality of fan blades, and a supporting member for securely supporting said fan blades, said supporting member being rotatably mounted on said rotatable shaft and including a plurality of bores.

6. A cooling system as claimed in claim 4, wherein said drive pulley includes an annular disc portion which is formed with a plurality of openings which are spaced apart from each other and said electromagnetic member comprises an annular shape and is disposed about said rotatable shaft in alignment with said openings.

7. A cooling system as claimed in claim 6, wherein the connecting member of said clutch includes an annular disc made of said magnetic material and located so as to be contactable to the surface of the annular disc portion of said drive pulley, and a plurality of pins secured to said annular disc disposed so as to movably engage in the bores of said supporting member of said cooling fan.

8. A cooling system as claimed in claim 1, wherein said predetermined amount of the throttle valve opening is 90% of an angle defined between the fully closed and fully opened positions of the throttle valve, and said predetermined position of the gear range in the gear box is in the range of low gear position and second gear position.

9. A cooling system as claimed in claim 2, wherein said normally closed switch comprises an electromagnetic relay which is closed only when energized, whereby said electromagnetic member will be de-energized when said relay is de-energized.

10. A cooling system as claimed in claim 9, wherein said throttle position switch includes: p1 a cam which is arranged to move with the throttle valve and has a predetermined cam face, a cam follower member slidably contacting the cam face of said cam, and a switch having a movable contact which is electrically connected to said electromagnetic relay; said movable contact being mechanically connected to said cam follower member and arranged to be opened by said cam follower member when the throttle valve opens over said predetermined amount.

11. A cooling system as claimed in claim 5, further comprising a fluid coupling for rotating said cooling fan in accordance with the rotation of said rotatable shaft even after the mechanical connection between said drive pulley and said cooling fan is released.

12. A cooling system as claimed in claim 1, further comprising an engine coolant temperature switch which is arranged to close to engage said clutch when engine coolant temperature is below a first predetermined level.

13. A cooling system as claimed in claim 9, further comprising a first engine coolant temperature switch which is arranged to open to de-energize said electromagnetic relay when engine coolant temperature is below a first predetermined level.

14. A cooling system as claimed in claim 13, wherein said first predetermined level of the engine coolant temperature is about 60° C.

15. A cooling system as claimed in claim 2, wherein said cooling fan is arranged to cool an engine coolant which is recirculated in the engine.

16. A cooling system as claimed in claim 1, wherein said second engine operating condition is an engine acceleration under a high load and low vehicle speed operating condition.

17. A cooling system as claimed in claim 1, wherein said second engine operating condition detecting means comprises an acceleration sensitive switch electrically connected in parallel with said throttle position switch and arranged to open when the venturi vacuum increasing rate reaches to a certain level representing engine acceleration.

18. A cooling system as claimed in claim 17, wherein said acceleration sensitive switch comprises a casing forming therein a space, a diaphragm member dividing the space into an atmospheric chamber which communicates with the atmosphere and a vacuum chamber which communicates with a venturi formed in an intake passageway upstream of the throttle valve, a connecting pipe connecting the atmospheric chamber and the vacuum chamber, said pipe including therein an orifice for restricting the air flow between the atmospheric and vacuum chambers, a compression spring disposed in the vacuum chamber to urge said diaphragm member in a direction to increase the volume of the vacuum chamber, and a movable contact secured to said diaphragm member and exposed to the atmospheric chamber, and two stationary contacts secured to and insulated from said casing, one of said stationary contacts being electrically connected to said normally closed switch and the other being grounded, said two stationary contacts being located opposite to and contactable simultaneously with said movable contact.

19. A cooling system as claimed in claim 13, further comprising a second engine coolant temperature switch electrically connected in parallel with said normally closed switch to energize said electromagnetic member of said clutch when the engine coolant temperature is above a second predetermined level above which overheating of the engine occurs.

20. A cooling system as claimed in claim 19, in which said second predetermined level of the engine coolant temperature is 95° C.

* * * * *

UNITED STATES PATENT OFFICE

CERTIFICATE OF CORRECTION

Patent No. 4,275,688 Dated June 30, 1981

Inventor(s) Fumiyuki ABE and Yoshimasa HAYASHI

It is certified that error appears in the above-identified patent and that said Letters Patent are hereby corrected as shown below:

FOREIGN APPLICATION PRIORITY DATA -

First listed Priority Application -

Kindly delete "52-1265" and insert instead -- 52-51265 --.

Signed and Sealed this

*Thirteenth* Day of *October 1981*

[SEAL]

*Attest:*

GERALD J. MOSSINGHOFF

*Attesting Officer*

*Commissioner of Patents and Trademarks*